US006733362B2

(12) United States Patent
Plew

(10) Patent No.: US 6,733,362 B2
(45) Date of Patent: May 11, 2004

(54) BRASSIERE

(76) Inventor: Katerina Plew, 220 Adirondack Dr., Selden, NY (US) 11784

( * ) Notice: Subject to any disclaimer, the term of this patent is extended or adjusted under 35 U.S.C. 154(b) by 0 days.

(21) Appl. No.: 10/173,946

(22) Filed: Jun. 18, 2002

(65) Prior Publication Data

US 2003/0232573 A1 Dec. 18, 2003

(51) Int. Cl.[7] ..... A41C 3/00
(52) U.S. Cl. ..... 450/86; 450/1; 2/67
(58) Field of Search ..... 450/1, 81, 90, 450/86, 88; 2/67, 255, 258, 260, 274, 73, 78.1–78.3

(56) References Cited

U.S. PATENT DOCUMENTS 2,289,679 A * 7/1942 Porter ..... 2/267
2,524,620 A * 10/1950 Cadous ..... 450/81
2,628,356 A * 2/1953 Rosenfield et al. ..... 450/81
2,753,569 A * 7/1956 Schmalz ..... 450/86
2,780,418 A * 2/1957 Garson ..... 450/86
2,988,287 A * 6/1961 Krieger ..... 450/81
3,244,175 A * 4/1966 Sturges ..... 450/90
3,254,653 A * 6/1966 Krieger ..... 450/81
3,306,299 A * 2/1967 Paramore ..... 450/86
3,527,231 A * 9/1970 Catanese et al. ..... 450/86
6,086,451 A * 7/2000 Fernandes ..... 450/86
6,332,825 B1 * 12/2001 Henricksen ..... 450/81

* cited by examiner

*Primary Examiner*—Gloria M. Hale

(57) ABSTRACT

An improved brassiere of the type having a pair of cups, torso bands, and shoulder strap, and apparatus for connecting the pair of shoulder straps. The improvement includes the apparatus including a strip of fabric loops extending along free upper edges of the pair of torso bands and free upper edges of the pair of cups, a pair of fabric loops that are overlying aligned with each other, and are disposed in a space between the pair of cups at free upper edges of the pair of cups, an upper strip of material that is preferably silicon and overlies the strip of fabric loops and the pair of fabric loops for preventing discomfort to a wearer and keeping the brassiere in place, and a lower strip of material that is preferably silicon and overlies free lower edges of the pair of torso bands for further keeping the brassiere in place.

9 Claims, 2 Drawing Sheets

BRASSIERE

BACKGROUND OF THE INVENTION

1. Field of the Invention

The present invention relates to a brassiere. More particularly, the present invention relates to an improved brassiere.

2. Description of the Prior Art

Undergarments for women are manufactured and marketed in a variety of colors, fabrics, and styles. The need for a variety in part relates to the variety of outer garments most often worn in conjunction with the undergarments. Frequently the outer garments do not fully and completely cover the undergarments, so it becomes necessary for the garments to appear similar or at least complimentary. This occurs most commonly with women's brassieres worn in conjunction with shirts or dresses that have shoulder straps. It is frequently impossible to keep the shoulder straps of the brassiere from being exposed under the shoulder straps of the dress or shirt. It is undesirable for these two sets of straps to be of different colors, textures or materials.

To address this problem, many women attempt to buy and wear a brassiere that matches each different shirt or dress that they own. This obviously can become expensive and impractical since the color and material array of shirts and dresses is much wider than that associated with brassieres.

It would be desirable if it were possible to change the appearance of the brassiere straps without changing the entire brassiere. The same would be true for any of a number of different women's undergarments such as body briefs, camisoles and the like. It would further be desirable if the mechanisms for altering and varying the appearance of the straps on an undergarment could be readily adaptable, not only in appearance, but in the manner in which they are attached to the undergarment.

Numerous innovations for upper torso garments have been provided in the prior art that will be described infra. Even though these innovations may be suitable for the specific individual purposes to which they address, however, they differ from the present invention in that efforts in the past to provide the required versatility have been limited.

FOR EXAMPLE, U.S. Pat. No. 2,005,094 tp Zweben teaches an apparel garment adapted to extend around wearer, a unitary tape forming shoulder straps, the ends of which are respectively connectible to the front right and left-hand portions of the same, the back of the garment being constructed to include therein a plurality of circumferentially spaced openings, through any pair of which the tape freely passes to afford the wearer adjustment for the amount of circumferential extension of the tape at the back of the garment.

ANOTHER EXAMPLE, U.S. Pat. No. 2,882,907 to Puliafico, as shown in FIG. 1, teaches a shoulder strap-type garment 10 that comprises a garment body 12 having a pair of cups 14 with body-facing surfaces 16 having free upper edges 18 and a pair of torso bands 20 with body-facing surfaces 22 having free upper edges 24 and free lower edges 26 and extending from the pair of cups 14, respectively, a pair of shoulder strap 28 having ends 30 with S-hooks 32 thereon, and means 34 for separably and adjustably connecting the pair of shoulder straps 28 to the garment body 12. The means comprises a tape extending longitudinally on the upper edge portion of the body so that the upper edge portion of the body underlies the full width of the tape. Parallel lines of stitching extend through both longitudinal edges of the tape and secure the same to the body. The tape includes a zig-zag element affording a longitudinal extending row of loops between the lines of stitching. A hook-shaped member is separably and selectively connectible with the loops for adjusting the point of attachment of the shoulder strap to the body in a direction longitudinally of the tape. Then upper edge portion of the body underlies and secured to the tape of the lines of stitching serving to hold the tape flat against the body to resist accidental separation of the connecting member therefrom.

STILL ANOTHER EXAMPLE. U.S. Pat. No. 5,024,628 Sanchez teaches a maternity and nursing bra incorporating a one-handed fastening method that inherently allows for a stronger cup Support and variable adjustment of cup size. It is accomplished by affixing parts of a fastener to the inside of an inner cup to an inner band. Also incorporated into the inside of the inner cup is an optional use nursing pad pocket. The bra's variable strap width adjusting band and the relocatable shoulder straps enable the bra to be worn with a variety of outer garment styles.

VET ANOTHER EXAMPLE. U.S. Pat. No. 5,388,273 to Sydor et al. teaches a support stay for use with an article to be worn by a person that has two durometers of hardness. The support stay includes a base member having a first hardness, the first hardness sufficient to provide a required rigidity for support. A gripping member is operatively connected to the base member. The gripping member has a second hardness which is softer than the first hardness. The gripping member, when attached to the inner surface of the article, provides a non-slip surface against the person wearing the article to keep the article in position.

STILL YET ANOTHER EXAMPLE, U.S. Pat. No. 6,155,906 to May teaches one or more undergarment foundations and a number of attachable accessory straps that together make up a garment set. The set may be purchased together and would include one or more undergarment foundation articles of clothing, such as a women's brassiere, and a number of distinct strap sets, each of the strap sets having at least one strap and preferably two. Each of the straps within a set have strap connectors at each end that are removably attachable to strap attachment points on the undergarment itself. The different strap sets within the garment set are distinct, one for the other, in that the fabrics, colors, textures, sizes, and shapes are distinct. The individual wearing one of the undergarment foundations and the associated strap accessories may choose to match an outer garment worn in conjunction with the foundation or may choose to appropriately contrast the straps of the undergarment from those of the outer garment. In any case, the wearer is able to construct these variations without the need to separately purchase many different complete undergarments.

YET STILL ANOTHER EXAMPLE, U.S. Pat. No. 6,205,585 to Capparelli teaches a garment that replaces a full shirt or blouse which is comprised of a frontal portion piece of material that attaches to an undergarment by the engagement of male and female snaps around the undergarment. The garment is fastened around the torso of the wearer by means of an elastic band with a hook which engages an elastic loop. Three female snaps are provided in order to adjust the drape of the neckline of the garment. An optional scarf may be attached to the garment in order to create a matching ensemble.

STILL YET ANOTHER EXAMPLE, U.S. Pat. No. 6,279,171 to Brancato teaches ornamental jewelry supports for garments, particularly for upper torso garments worn by women such as bras, bikini tops, halters, strapless dresses, and the like. The garment supports are adjustable along their length with adjusting mechanisms that do not result in unsightly overlap of the ornamental lengths of jewelry of the present garment supports. The adjustable ornamental garment supports can be readily moved from one garment to another and do not require puncturing the garment.

YET STILL ANOTHER EXAMPLE, U.S. Publication Number 2002/0022434A1 to Plourde et al. teaches a fastener mountable on a brassiere strap, either removably or permanently. A brassiere strap mounted on the fasteners can be removably affixed to a location on the posterior strap assembly and a location on the anterior cups of a brassiere. Use of the fasteners permits adjustment of the brassiere straps into a plurality of different arrangements, depending upon the shape, outfit and activity of the wearer. The brassiere straps and fasteners can be made of transparent or translucent materials which may be color tinted so as to appear virtually invisible against the wearer's skin. The brassiere straps can also be removed from a brassiere altogether.

It is apparent that numerous innovations for upper torso garments have been provided in the prior art that are adapted to be used. Furthermore, even though these innovations may be suitable for the specific individual purposes to which they address, however, they would not be suitable for the purposes of the present invention as heretofore described in that none of the efforts in the past have adequately addressed the need for a single undergarment foundation to which might be attached a number of distinct shoulder straps for use in conjunction with a similar variety of outer garments.

SUMMARY OF THE INVENTION

ACCORDINGLY, AN OBJECT of the present invention is to provide an improved brassiere that avoids the disadvantages of the prior art.

ANOTHER OBJECT of the present invention is to provide an improved brassiere that is simple to use.

BRIEFLY STATED, STILL ANOTHER OBJECT of the present invention is to provide an improved brassiere of the type having a pair of cups, torso bands, and shoulder strap, and apparatus for connecting the pair of shoulder straps. The improvement includes the apparatus including a strip of fabric loops extending along free upper edges of the pair of torso bands and free upper edges of the pair of cups, a pair of fabric loops that are overlying aligned with each other, and are disposed in a space between the pair of cups at free upper edges of the pair of cups, an upper strip of material that is preferably silicon and overlies the strip of fabric loops and the pair of fabric loops for preventing discomfort to a wearer and keeping the brassiere in place, and a lower strip of material that is preferably silicon and overlies free lower edges of the pair of torso bands for further keeping the brassiere in place.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawing are briefly described as follows.

LIST OF REFERENCE NUMERALS UTILIZED IN THE DRAWING

Prior Art

Figure 1:
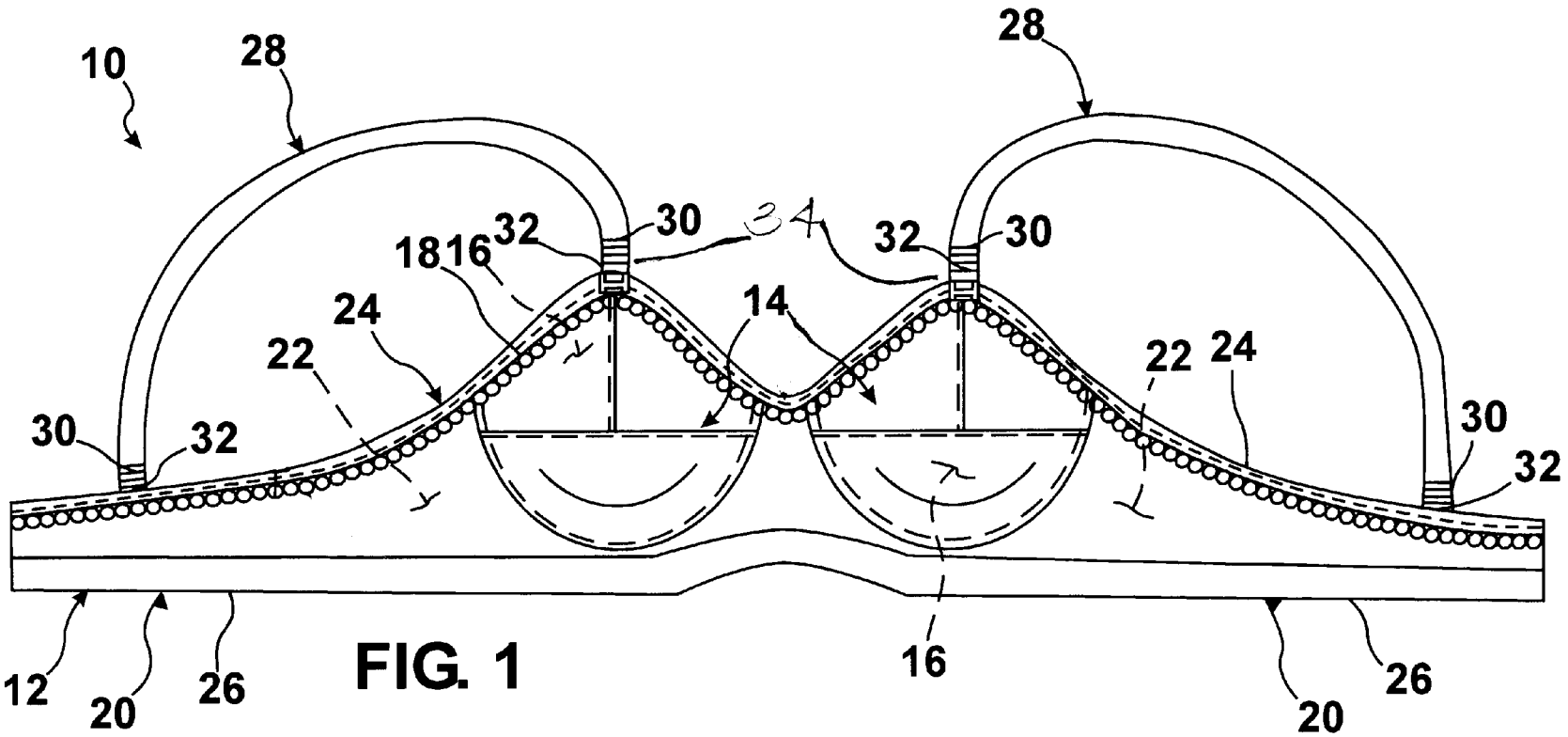
FIG. 1 Prior art
FIG. 1 is a diagrammatic perspective view of a prior art brassiere taught by U.S. Pat. No. 2,882,907 to Puliafico.

10 shoulder strap-type garment
12 garment body
14 pair of cups of garment body 12
16 body-faciig surfaces of pair of cups 14 of garment body 12
18 free upper edges of body-facing surfaces 16 of pair of cups 14 of garment body 12
20 pair of torso bands of garment body 12
22 body-facing surfaces of pair of torso bands 20 of garment body 12
24 free upper edges of body-facing surfaces 22 of pair of torso bands 20 of garment body 12
26 free lower edges of body-facing surfaces 22 of pair of torso bands 20 of garment body 12
28 pair of shoulder strap
30 ends of pair of shoulder strap 28
32 S-hooks on ends 30 of pair of shoulder strap 28
34 means for separably and adjustably connecting pair of shoulder straps 28 to garment body 12

Present Invention

40 improved brassiere of present invention
42 strip of fabric loops of means 34
43 base of strip of fabric loops 42 of means 34
44 pair of fabric loops of means 34
46 upper strip of material of means 34 for preventing discomfort to wearer and keeping improved brassiere 40 in place
48 lower strip of material for further keeping improved brassiere 40 in place

DETAILED DESCRIPTION OF THE PREFERRED EMBODIMENT

Figure 2:
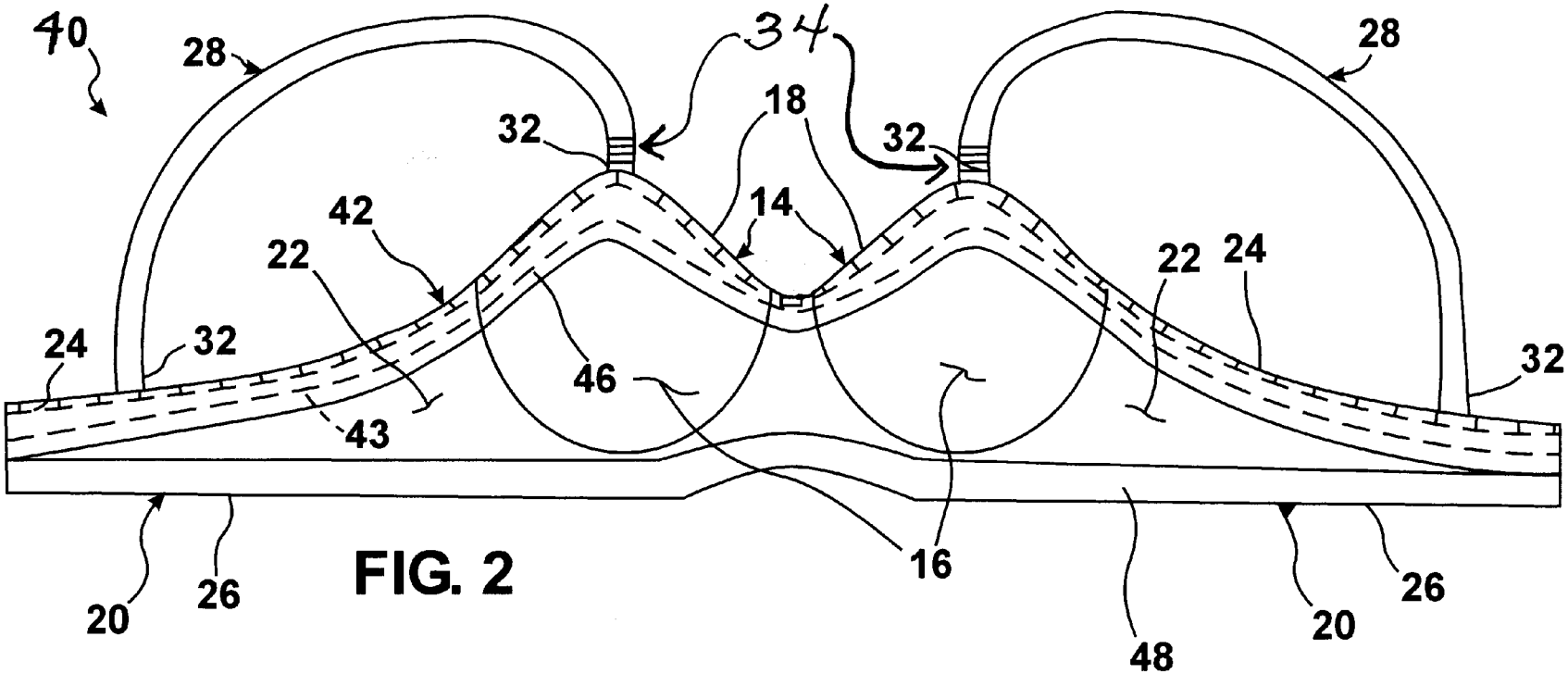
FIG. 2 is a diagrammatic rear elevational view of the improved brassiere of the present invention.

Referring now to the figures, in which like numerals indicate like parts, and particularly to FIG. 2, which is a diagrammatic rear elevational view of the improved brassiere of the present invention, the improved brassiere of the present invention is shown generally at 40.

The improvement comprises the means 34 comprising a strip of fabric loops 42. The strip of fabric loops 42 extend along, and just below so as to be hidden by, the free upper edges 24 of the body-facing surfaces 22 of the pair of torso bands 20 and the free upper edges 18 of the body-facing surfaces 16 of the pair of cups 14.

The improvement further comprises each fabric loop of the strip of fabric loops 42 being separate from each other, but held together at a base 43.

The improvement comprises the strip of fabric loops 42 being separated between the pair of cups 14 so as to form a space therebetween.

The improvement further comprises the means 34 farther comprising a pair of fabric loops 44. The pair of fabric loops 44 are overlying aligned with each other, and are disposed in the space between the pair of cups 14, just below so as to be hidden by, the free upper edges 18 of the body-facing surfaces 16 of the pair of cups 14.

The improvement further comprises selected ones of the strip of fabric loops 42 and the pair of fabric loops 44 receive the S-hooks 32 of the pair of shoulder straps 28. The selected ones of the strip of fabric loops 42 and the pair of fabric loops 44 comprise a fabric loop from each torso band 20 and a fabric loop from each cup 14 or the pair of loops 44.

The improvement further comprises the means 34 further comprising an upper strip of material 46. The upper strip of material 46 overlies the strip of fabric loops 42 and the pair of fabric loops 44 for preventing discomfort to a wearer.

The improvement further comprises the upper strip of material 46 being an elastomer, preferably silicon, for keeping the improved brassiere 40 in place.

The improvement further a lower strip of material 48. The lower strip of material 48 overlies the free lower edges 26 of the body-facing surfaces 22 of the pair of torso bands 20, and is an elastomer, preferably silicon, for further keeping the improved brassiere 40 in place.

It will be understood that each of the elements described above, or two or more together, may also find a useful application in other types of constructions differing from the types described above.

While the invention has been illustrated and described as embodied in an improved brassiere, however, it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. An improved brassiere of the type having a garment body having a pair of cups with body-facing surfaces having free upper edges and a pair of torso bands with body-facing surfaces having free upper edges and free lower edges and extending from the pair of cups, respectively, a pair of shoulder straps having ends with S-hooks thereon, and means for separably and adjustably connecting the pair of shoulder straps to the garment body, wherein the improvement comprises:

a) the means comprising a strip of fabric loops extending along, and just below so as to be hidden by, the free upper edges of the body-facing surfaces of the pair of torso bands and the free upper edges of the body-facing surfaces of the pair of cups;

b) said strip of fabric loops being separated between the pair of cups so as to form a space therebetween;

c) the means further comprising a pair of fabric loops overlying aligned with each other, and being disposed in said space between the pair of cups, just below so as to be hidden by, the free upper edges of the body-facing surfaces of the pair of cups; and d) the means further comprising an upper strip of material overlying said strip of fabric loops and said pair of fabric loops for preventing discomfort to a wearer.

2. The improved brassiere as defined in claim 1, wherein the improvement comprises each fabric loop of the strip of fabric loops being separate from each other, but held together at a base.

3. The improved brassiere as defined in claim 1, wherein the improvement comprises selected ones of said strip of fabric loops and said pair of fabric loops receiving the S-hooks of the pair of shoulder straps.

4. The improved brassiere as defined in claim 3, wherein the improvement comprises said selected ones of said strip of fabric loops and said pair of fabric loops comprising a fabric loop from each torso band and a fabric loop from each cup or said pair of loops.

5. The improved brassiere as defined in claim 1, wherein the improvement comprises said upper strip of material being an elastomer for keeping said improved brassiere in place.

6. The improved brassiere as defined in claim 5, wherein the improvement comprises said elastomer of said upper strip of material being silicon.

7. The improved brassiere as defined in claim 1, wherein the improvement comprises a lower strip of material overlying the free lower edges of the body-facing surfaces of the pair of torso bands.

8. The improved brassiere as defined in claim 7, wherein the improvement comprises said lower strip of material being an elastomer for keeping said improved brassiere in place.

9. The improved brassiere as defined in claim 8, wherein the improvement comprises said elastomer of said lower strip of material being silicon.

* * * * *